US006767062B2

(12) United States Patent
Piretti

(10) Patent No.: US 6,767,062 B2
(45) Date of Patent: Jul. 27, 2004

(54) CHAIR WITH OSCILLATING SEAT

(76) Inventor: Giancarlo Piretti, c/o Pro-Cord Spa Via del Battiferro, 4, I-40129 Bologna (IT)

( * ) Notice: Subject to any disclaimer, the term of this patent is extended or adjusted under 35 U.S.C. 154(b) by 38 days.

(21) Appl. No.: 09/873,033

(22) Filed: Jun. 1, 2001

(65) Prior Publication Data

US 2001/0050503 A1 Dec. 13, 2001

(30) Foreign Application Priority Data

Jun. 9, 2000 (IT) ..... TO2000A0557

(51) Int. Cl.[7] ..... A47C 1/023
(52) U.S. Cl. ..... 297/337
(58) Field of Search ..... 297/337, 311, 297/344.1, 344.11, 344.13, 344.14, 302.1, 302.4, 313, 258.1, 259.1, 261.1

(56) References Cited

U.S. PATENT DOCUMENTS 1,838,199 A * 12/1931 Thomas
2,161,366 A * 6/1939 McGregor
3,542,326 A * 11/1970 Reapsummer
3,785,700 A 1/1974 Kubo
4,549,765 A * 10/1985 Hoch
5,035,466 A * 7/1991 Mathews et al.
5,374,102 A * 12/1994 Archambault et al.
5,607,204 A * 3/1997 Gryp
5,884,887 A * 3/1999 Garelick et al.
5,988,749 A * 11/1999 Williams

FOREIGN PATENT DOCUMENTS

DE 295 07 658 U 2/1996

* cited by examiner

*Primary Examiner*—Milton Nelson, Jr.
(74) *Attorney, Agent, or Firm*—TraskBritt

(57) ABSTRACT

A chair, in particular a chair for office use, including: a base support (14); a seat-supporting structure (16) mounted in an oscillating way with respect to the base support (14); and a seat (18), mounted so that it can slide in the longitudinal direction on the seat-supporting structure (16). The seat (18) and the seat-supporting structure (16) are provided with arrest structures (42, 46, 50) defining a plurality of clamping positions for clamping the seat.

5 Claims, 3 Drawing Sheets

CHAIR WITH OSCILLATING SEAT

The present invention relates to a chair, in particular a chair for office use, comprising:

a base support;

a seat-supporting structure mounted in an oscillating way with respect to the base support; and a seat carried by the seat-supporting structure.

The aim of the present invention is to provide a chair of the type specified above that enables a high degree of comfort to be achieved irrespective of the stature of the person occupying the chair.

According to the present invention, the above purpose is achieved by a chair having the characteristics that form the subject of claim 1.

The present invention will now be described in detail with reference to the attached drawings, which are provided purely by way of non-limiting example, and in which.

Figure 1:
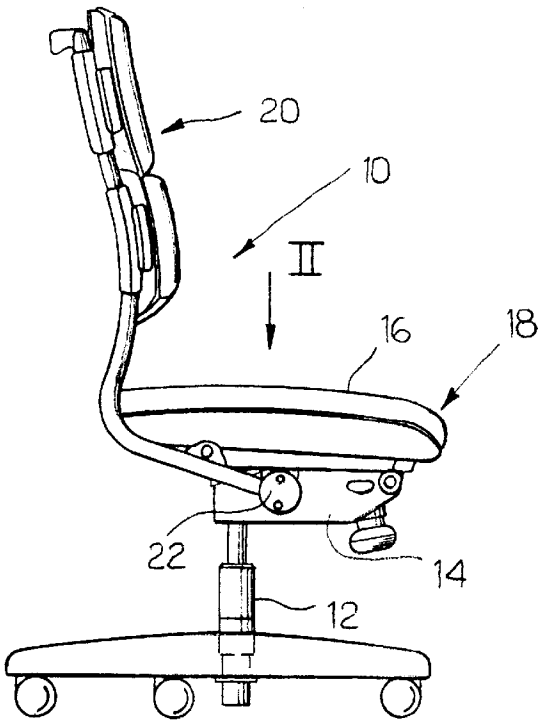
FIG. 1 is a side view of a chair according to the present invention.

With reference to FIG. 1, a chair according to the present invention is designated by 10. The chair 10 comprises a central support 12, which is height-adjustable and at the top of which a base support 14 is fixed. The chair 10 comprises a seat-supporting structure 16, which carries a seat 18. The seat-supporting structure 16 is carried in an oscillating way by the base structure 14. The chair 10 comprises a backrest 20, which, in the example illustrated in the figures, is carried by the base structure 14 in an oscillating way about a transverse axis 22 and is provided with an oscillating movement synchronized with the oscillating movement of the seat-supporting structure 16. The mechanism that enables synchronized oscillation of the seat and backrest may, for example, be of the type described in the Italian patent application No. TO2000A000538.

Figure 2:
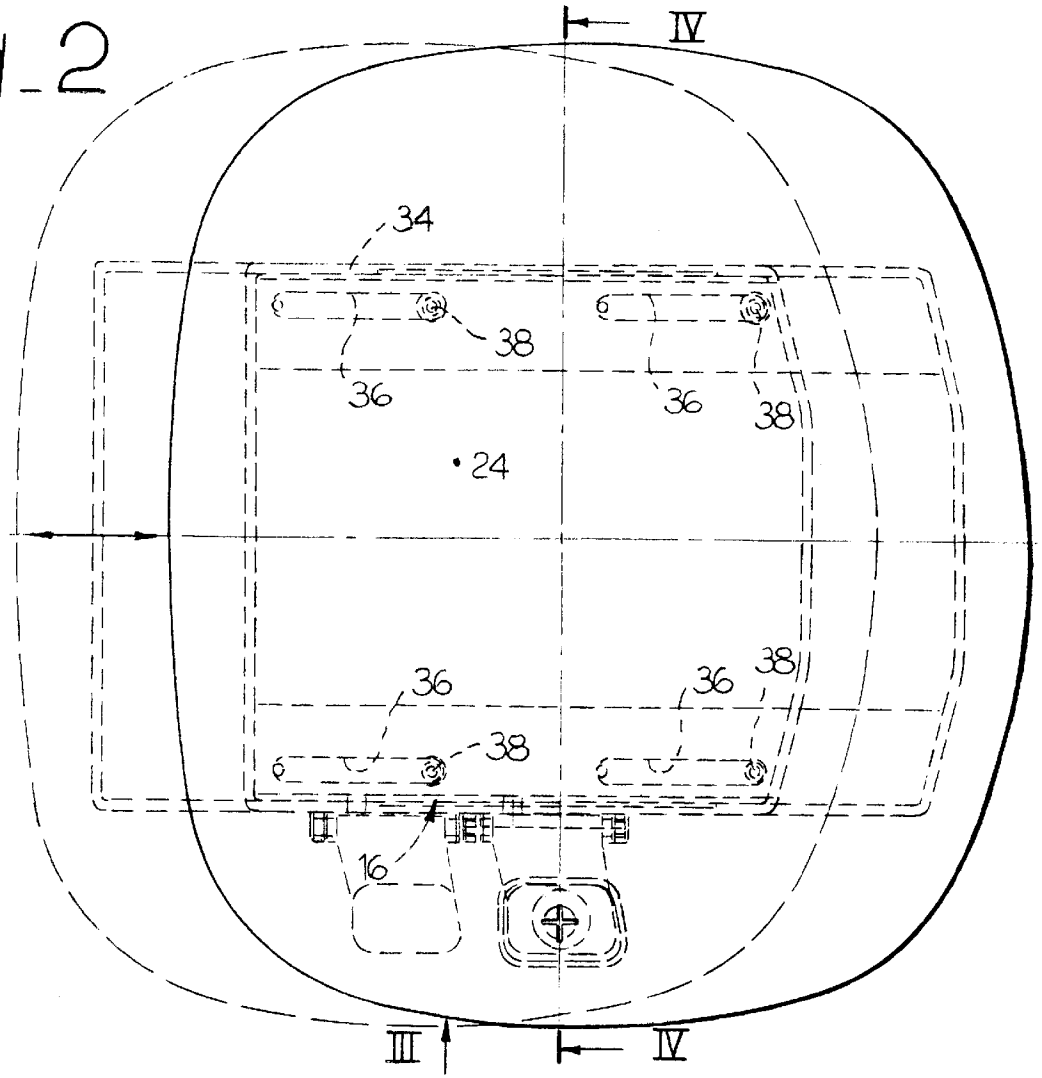
FIG. 2 is a plan view according to the arrow II of FIG. 1.
Figure 4:
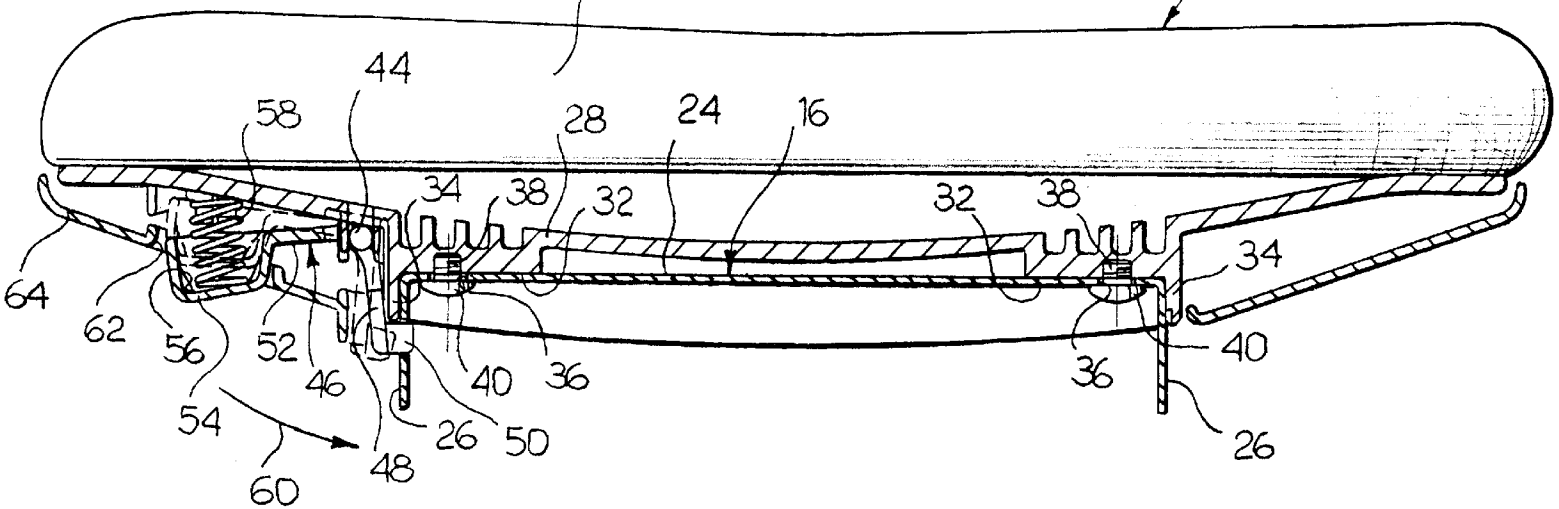
FIG. 4 is a section according to the line IV—IV of FIG. 2.

With reference to FIGS. 2 and 4, the seat-supporting structure 16 is basically constituted by a bent steel sheet, the cross section of which has a general configuration of an inverted U with a plane top face 24 and two parallel side walls 26.

The seat 18 comprises a reinforcement 28 carrying a padding 30. As may be seen in particular in FIG. 4, the reinforcement 28 has bottom sliding surfaces 32 which rest on the top surface 24 of the seat-supporting structure 16. The reinforcement 28 further has a pair of side flanges 34 set externally and in sliding contact with the side walls 26 of the seat-supporting structure 16. With reference to FIG. 2, the top part 24 of the seat-supporting structure 16 has four slits 36 elongated in the longitudinal direction and slidably engaged by respective pins 38 carried by the reinforcement 28 of the seat 18. As may be seen in FIG. 4, each of the pins 38 has a head 40 that engages the bottom part of the wall 24, in this way constraining the seat 18 to the seat-supporting structure 16 in the vertical direction, at the same time leaving the seat 18 free to slide in the longitudinal direction with respect to the seat-supporting structure 16. The sliding movement in the longitudinal direction of the seat 18 with respect to the seat-supporting structure 16 is guided by the engagement between the side flanges 34 of the seat reinforcement 28 and the side walls 26 of the seat-supporting structure 16. Engagement between the slits 36 and the pins 38 defines two end-of-travel positions of the seat 18 with respect to the seat-supporting structure 16.

Figure 3:
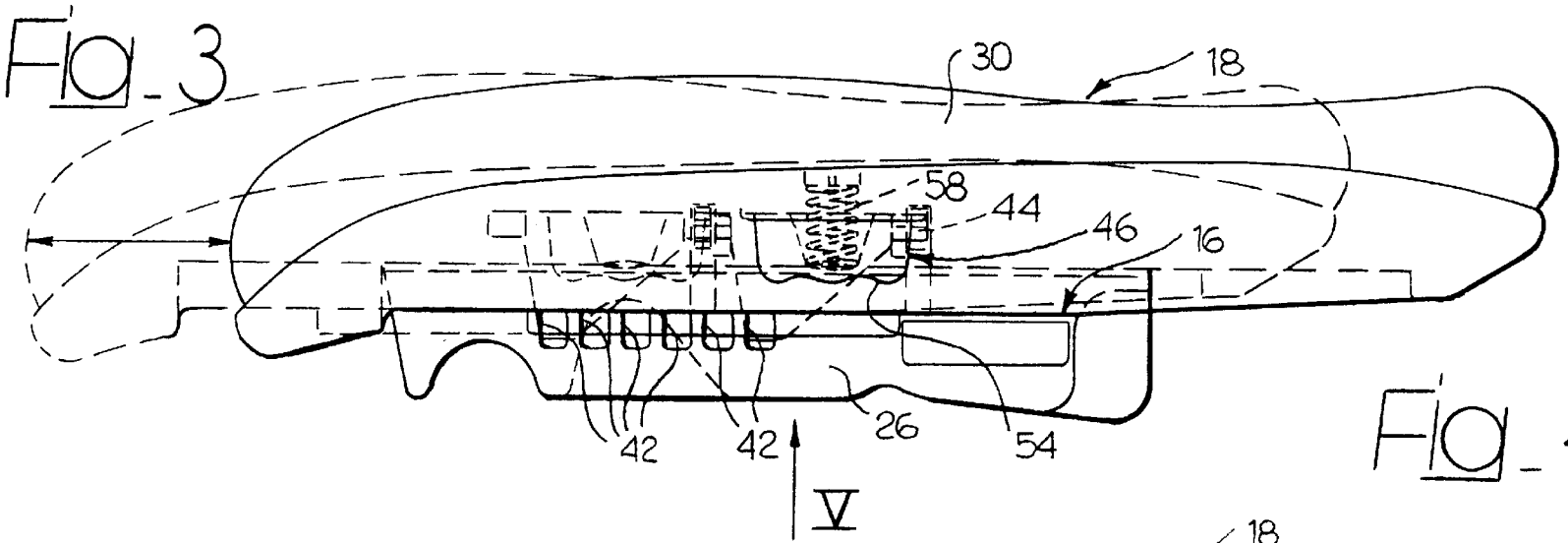
Figure 5:
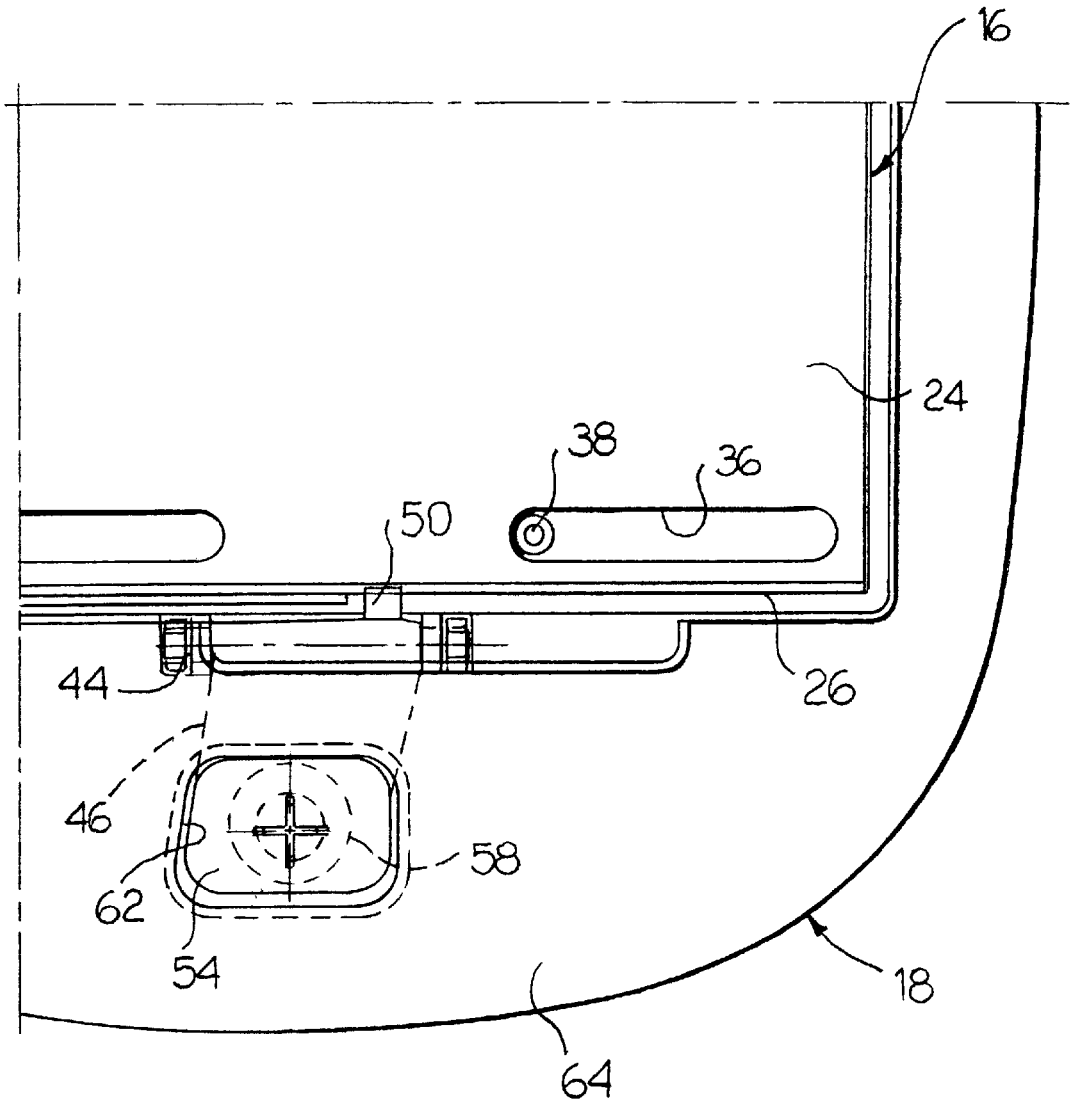
FIG. 5 is a partial view from beneath according to the arrow V of FIG. 3.

With reference to FIGS. 3, 4 and 5, one of the side walls 26 of the seat-supporting structure 16 is provided with a plurality of positioning holes 42. The reinforcement 28 of the seat 18 carries a pivot 44 which extends in the longitudinal direction, i.e., in a direction parallel to the sliding direction of the seat 18 with respect to the seat-supporting structure 16. A lever 46 is mounted in an oscillating way about the pivot 44. The lever 46 comprises a first arm 48 having at one of its ends an engagement tooth 50 which is designed to engage one of the positioning holes 42. A second arm 52 of the lever 46 has an actuating portion 54 which presents a cavity 56 in which is housed a helical spring in compression 58 that acts against the reinforcement 28 of the seat 18 and tends to cause the lever 46 to oscillate in the direction indicated by the arrow 60 in FIG. 4. The actuation portion 54 of the lever 56 protrudes through an opening 62 formed in a bead or rim 64 which is set on the underside of the seat and is fixed to the reinforcement 28.

The position of the seat 18 is adjustable in the longitudinal direction with respect to the seat-supporting structure 16. To vary the position of the seat, the user, while sitting in the chair, inserts his hand underneath the seat and exerts a pressure upwards on the actuating portion 54 of the lever 46 against the action of the spring 58, in this way releasing the seat from the seat-supporting structure 16. After releasing the seat, the user may cause the seat to slide forwards or backwards until the most appropriate position for his requirements is reached, and then releases the lever 46, which, under the action of the spring 58, returns to an engagement position. If, in the new position of the seat 18, the tooth 50 of the lever 46 is not exactly in a position corresponding to a hole 42, the user, after releasing the lever 46, must get the seat to accomplish a slight sliding movement either forwards or backwards to block the seat in the new position in order to bring the tooth into a condition of engagement within one of the holes 42. The user can thus vary the distance between the backrest and the front edge of the seat to adjust it to the length of his thigh. In particular, users of taller stature will find it more comfortable to shift the seat forwards, whereas users of shorter stature will find it more comfortable to shift the seat backwards. The range of adjustment of the seat 18 may be determined so as to enable a wide range of users to obtain a resting position for their legs on the seat for a length that substantially corresponds to the length between the individual's thigh and his knee.

What is claimed is:

1. A chair, in particular a chair for office use, comprising:

a base support;

a seat-supporting structure mounted in an oscillating way with respect to the base support; and a seat, carried by the seat-supporting structure, the seat being mounted so that it can slide in a longitudinal direction on the seat-supporting structure, the seat and the seat-supporting structure being provided with a mutually cooperating arrest means defining a plurality of clamping positions for clamping the seat;

wherein the seat-supporting structure has a cross section with a generally inverted "U"-shaped configuration and the seat comprises a rigid reinforcement provided with surfaces which provide a sliding connection in the longitudinal direction on the generally inverted "U"-shaped configuration of the seat-supporting structure.

2. The chair according to claim 1, comprising a pin-and-slit-type engagement structure set between the seat-supporting structure and the reinforcement of the seat and designed to constrain the seat to the seat-supporting structure in a direction orthogonal to the direction of relative sliding between the seat and the seat-supporting structure.

3. The chair according to claim 1, wherein the seat-supporting structure has a plurality of positioning holes formed in one of its longitudinal side walls and the reinforcement carries a disengageable arrest structure cooperating with said plurality of positioning holes.

4. The chair according to claim 3, wherein said disengageable arrest structure comprises a lever mounted in an oscillating way on the reinforcement about a longitudinal axis and an elastic structure provided for pushing said lever towards an engagement position.

5. The chair according to claim 4, wherein said lever has an actuation portion set on an underside of the seat.

* * * * *